US009644845B2

(12) United States Patent
Crothers et al.

(10) Patent No.: US 9,644,845 B2
(45) Date of Patent: May 9, 2017

(54) SYSTEM AND METHOD FOR REDUCING MODAL COUPLING OF COMBUSTION DYNAMICS

(71) Applicant: General Electric Company, Schenectady, NY (US)

(72) Inventors: Sarah Lori Crothers, Greenville, SC (US); Christian Xavier Stevenson, Blanchester, OH (US); William Francis Carnell, Jr., Greer, SC (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 14/170,710

(22) Filed: Feb. 3, 2014

(65) Prior Publication Data

US 2015/0219335 A1 Aug. 6, 2015

(51) Int. Cl.
*F23R 3/34* (2006.01)

(52) U.S. Cl.
CPC ..... *F23R 3/34* (2013.01); *F23R 2900/00014* (2013.01)

(58) Field of Classification Search
CPC ..... F23R 3/34; F23R 2900/00014
See application file for complete search history.

(56) References Cited

U.S. PATENT DOCUMENTS

| | | | | |
|---|---|---|---|---|
| 5,943,866 | A | 8/1999 | Lovett et al. | |
| 6,164,055 | A | 12/2000 | Lovett et al. | |
| 7,451,601 | B2 | 11/2008 | Taware et al. | |
| 7,578,130 | B1 | 8/2009 | Kraemer et al. | |
| 7,739,999 | B2 | 6/2010 | Kang et al. | |
| 8,112,216 | B2 | 2/2012 | Davis, Jr. et al. | |
| 8,322,140 | B2 | 12/2012 | Kim et al. | |
| 8,448,444 | B2 * | 5/2013 | Cihlar | F01D 9/023 60/772 |
| 2010/0192578 | A1 | 8/2010 | Singh et al. | |
| 2011/0072826 | A1 | 3/2011 | Narra et al. | |
| 2012/0006029 | A1 | 1/2012 | Bilbao et al. | |

* cited by examiner

*Primary Examiner* — Richard Chang
(74) *Attorney, Agent, or Firm* — Charlotte C. Wilson; Ernest G. Cusick; Frank A. Landgraff

(57) ABSTRACT

A system and method for reducing modal coupling of combustion dynamics among multiple combustors are provided. Each combustor may include one or more fuel nozzles axially aligned with a combustion chamber; one or more fuel injectors downstream from the fuel nozzles; and a set of flow openings integrated with the combustor. The fuel injectors provide fluid communication through a liner that circumferentially surrounds each combustion chamber. The flow rate of compressed working fluid diverted through the fuel injectors may be different and/or variable between the combustors to produce different combustion instability frequencies.

7 Claims, 7 Drawing Sheets

SYSTEM AND METHOD FOR REDUCING MODAL COUPLING OF COMBUSTION DYNAMICS

TECHNICAL FIELD

The present invention generally involves a system and method for reducing modal coupling of combustion dynamics. In particular embodiments, the system and method may be incorporated into a gas turbine or other turbomachine.

BACKGROUND

Combustors are commonly used in industrial and commercial operations to ignite fuel to produce combustion gases having a high temperature and pressure. For example, gas turbines and other turbomachines typically include one or more combustors to generate power or thrust. A typical gas turbine used to generate electrical power includes an axial compressor at the front, multiple combustors around the middle, and a turbine at the rear. Ambient air enters the compressor as a working fluid, and the compressor progressively imparts kinetic energy to the working fluid to produce a compressed working fluid at a highly energized state. The compressed working fluid exits the compressor and flows through one or more fuel injectors in the combustors where the compressed working fluid mixes with fuel before igniting to generate combustion gases having a high temperature and pressure. The combustion gases flow to the turbine where they expand to produce work. For example, expansion of the combustion gases in the turbine may rotate a shaft connected to a generator to produce electricity.

Combustion instabilities may occur during operation when one or more acoustic modes of the gas turbine are excited by the combustion process. For example, one mechanism of combustion instabilities may occur when the acoustic pressure pulsations cause a mass flow fluctuation at a fuel port which then results in a fuel/air ratio fluctuation in the flame. When the resulting fuel/air ratio fluctuation and the acoustic pressure pulsations have a certain phase behavior (e.g., in-phase or approximately in-phase), a self-excited feedback loop may result. This mechanism, and the resulting magnitude of the combustion dynamics, depends at least in part on the delay between the time that the fuel is injected through the fuel ports and the time when the fuel reaches the combustion chamber and ignites, defined as "convective time" (tau). Generally, there is an inverse relationship between convective time and frequency: that is, when the convective time increases, the frequency of the combustion instabilities decreases; and when the convective time decreases, the frequency of the combustion instabilities increases.

At particular operating conditions, combustion dynamics at specific frequencies and with sufficient amplitudes, which are in-phase and coherent, may produce undesirable sympathetic vibrations in the turbine and/or other downstream components. Typically, this problem is managed by combustor tuning that limits the amplitude of the combustion dynamics in a particular frequency band. However, conventional combustor tuning may unnecessarily limit the operating range of the combustor.

Altering the frequency relationship between two or more combustors may reduce the coherence of the combustion system as a whole, diminishing any combustor-to-combustor coupling. In the context of this invention, coherence refers to the strength of the linear relationship between two (or more) dynamic signals, which is strongly influenced by the degree of frequency overlap between them. As the combustion dynamics frequency in one or more combustors is driven away from that of the other combustors, modal coupling of combustion dynamics is reduced, which, in turn, reduces the ability of the combustor tone to cause a vibratory response in downstream components.

Therefore, a system and method that reduces the modal coupling of combustion dynamics by varying the convective time between combustors would be useful in enhancing the thermodynamic efficiency of the combustors, protecting against accelerated wear, promoting flame stability, and/or reducing undesirable emissions over a wide range of operating levels.

SUMMARY

Aspects and advantages of the invention are set forth below in the following description, or may be obvious from the description, or may be learned through practice of the invention.

The present invention includes a system for reducing modal coupling of combustion dynamics in a gas turbine. The system includes a first combustor comprising a first fuel nozzle, a first liner that defines a first combustion chamber downstream from the first fuel nozzle, a first set of flow openings integrated with the first combustor, and a first fuel injector downstream of the first fuel nozzle. The first set of flow openings defines a first collective effective area, and the first fuel injector defines a first effective cross-sectional area through the first liner into the first combustion chamber. A second combustor axially aligned with the first combustor comprises a second fuel nozzle, a second liner that defines a second combustion chamber downstream from the second fuel nozzle, a second set of flow openings integrated with the second combustor, and a second fuel injector downstream of the second fuel nozzle. The second set of flow openings defines a second collective effective area, and the second fuel injector defines a second effective cross-sectional area through the second liner into the second combustion chamber. The first collective effective area of the first set of flow openings is larger than the second collective effective area of the second set of flow openings, and the second effective cross-sectional area is larger than the first effective cross-sectional area.

Another aspect of the present invention is a method for reducing modal coupling of combustion dynamics in a gas turbine. The method includes: flowing a compressed working fluid to first and second combustors, each combustor having a liner that circumferentially surrounds a combustion chamber, a fuel injector providing fluid communication through the liner, and a set of flow openings integrated with the combustor; diverting a first portion of the compressed working fluid through a first fuel injector in the first combustor, wherein the first fuel injector provides fluid communication through a first liner that circumferentially surrounds a first combustion chamber in the first combustor. The method further includes diverting a second portion of the compressed working fluid through a second fuel injector in the second combustor, wherein the second injector provides fluid communication through a second liner that circumferentially surrounds a second combustion chamber in the second combustor. The flow rate of the second portion of the compressed working fluid is larger than the flow rate of the first portion of the compressed working fluid, and the first set of flow openings defines a first collective effective area that is larger than a second collective area defined by the second set of flow openings.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying Figures, in which.

DETAILED DESCRIPTION

Figure 1:
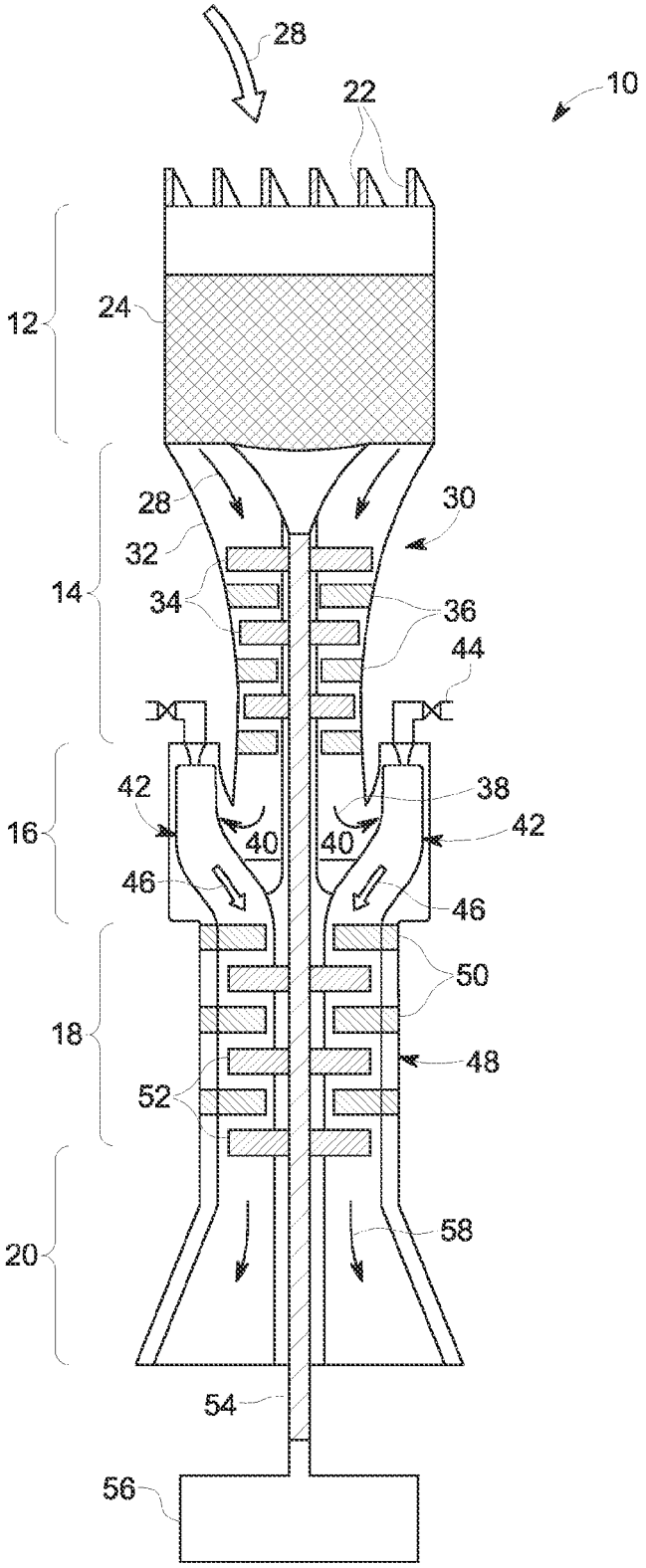
FIG. 1 is a simplified side cross-section view of an exemplary gas turbine according to various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows (e.g, through the fuel nozzles), and "downstream" refers to the direction to which the fluid flows (e.g., toward the turbine section). Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for reducing modal coupling of combustion dynamics. The system and method may be implemented in a gas turbine having multiple combustors, and each combustor may include one or more fuel nozzles axially aligned with a combustion chamber so that the fuel nozzles may mix fuel with a compressed working fluid prior to combustion. The system and method may further include one or more fuel injectors that provide fluid communication through a liner that circumferentially surrounds each combustion chamber, and the flow rate of compressed working fluid diverted through the fuel injectors may be different and/or variable between the combustors. In this manner, the system and method may vary the convective time for at least one of the combustors by varying the flow rate of the compressed working fluid flowing through the fuel nozzles, thereby reducing the modal coupling of combustion dynamics between combustors.

Although exemplary embodiments of the present invention will be described generally in the context of combustion dynamics in a gas turbine for purposes of illustration, one of ordinary skill in the art will readily appreciate that embodiments of the present invention may be applied to any combustion dynamics and are not limited to a gas turbine unless specifically recited in the claims.

Referring now to the drawings, wherein identical numerals indicate the same elements throughout the Figures, FIG. 1 provides a simplified side cross-section view of an exemplary gas turbine 10 that may incorporate various embodiments of the present invention. As shown, the gas turbine 10 may generally include an inlet section 12, a compressor section 14, a combustion section 16, a turbine section 18, and an exhaust section 20. The inlet section 12 may include a series of filters 22 and one or more fluid conditioning devices 24 to clean, heat, cool, moisturize, demoisturize, and/or otherwise condition a working fluid (e.g., air) 28 entering the gas turbine 10. The cleaned and conditioned working fluid 28 flows to a compressor 30 in the compressor section 14. A compressor casing 32 contains the working fluid 28 as alternating stages of rotating blades 34 and stationary vanes 36 progressively accelerate and redirect the working fluid 28 to produce a continuous flow of compressed working fluid 38 at a higher temperature and pressure.

The majority of the compressed working fluid 38 flows through a compressor discharge plenum 40 to one or more combustors 42 in the combustion section 16, two of which are illustrated. The combustors 42 may be any type of combustor known in the art, and the present invention is not limited to any particular combustor design unless specifically recited in the claims. The number of combustors 42 may vary. The combustors 42 are arranged circumferentially about a shaft 54, such that the inlet ends of the combustors 42 are co-planar and the outlet ends of the combustors 42 are co-planar. Said differently, the combustors 42 are "axially aligned," in that the combustors 42 occupy the same axial position along the longitudinal axis of the turbine (represented by the shaft 54).

A fuel supply 44 in fluid communication with each combustor 42 supplies a fuel to each combustor 42. Possible fuels may include, for example, blast furnace gas, coke oven gas, natural gas, methane, vaporized liquefied natural gas (LNG), hydrogen, syngas, butane, propane, olefins, diesel, petroleum distillates, and combinations thereof. The compressed working fluid 38 mixes with the fuel and ignites to generate combustion gases 46 having a high temperature and pressure.

The combustion gases 46 flow along a hot gas path through a turbine 48 in the turbine section 18 where they expand to produce work. Specifically, the combustion gases 46 may flow across alternating stages of stationary nozzles 50 and rotating buckets 52 in the turbine 48. The stationary nozzles 50 redirect the combustion gases 46 onto the next stage of rotating buckets 52, and the combustion gases 46 expand as they pass over the rotating buckets 52, causing the rotating buckets 52 to rotate. The rotating buckets 52 are connected to the shaft 54, which is coupled to the compressor 30 such that rotation of the shaft 54 drives the compressor 30 to produce the compressed working fluid 38. Alternately or in addition, the shaft 54 may connect to a generator 56 for producing electricity. Exhaust gases 58 from the turbine section 18 flow through the exhaust section 20 prior to release to the environment.

Figure 2:
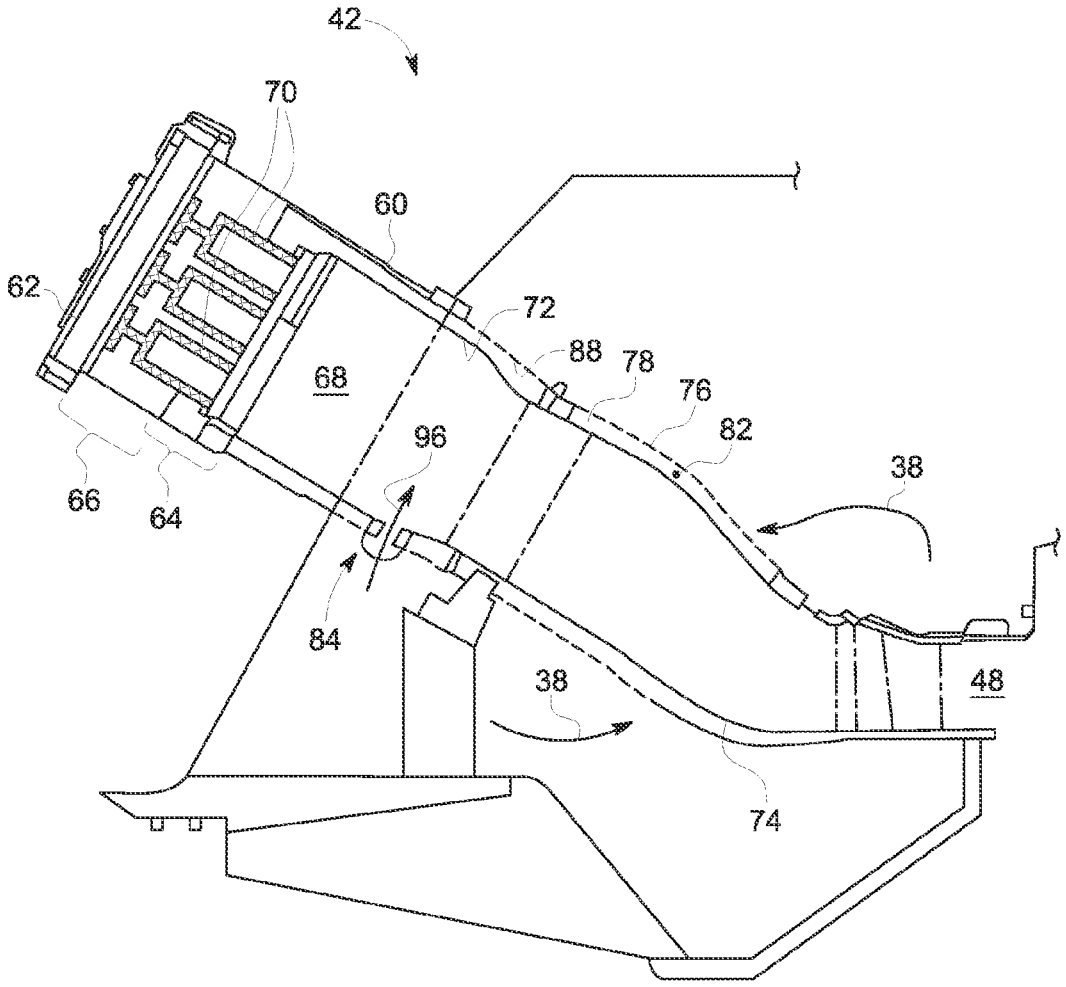
FIG. 2 is a simplified side cross-section view of an exemplary combustor according to various embodiments of the present invention.

FIG. 2 provides a simplified side cross-section view of an exemplary combustor 42 according to various embodiments of the present invention. As shown in FIG. 2, a combustor casing 60 and an end cover 62 may combine to contain the compressed working fluid 38 flowing to the combustor 42. A cap assembly 64 may extend radially across at least a portion of the combustor 42 to separate a head end 66 of the combustor from a combustion chamber 68 downstream from the cap assembly 64. One or more fuel nozzles 70 may be radially arranged across the cap assembly 64 to supply a mixture of fuel and compressed working fluid 38 from the head end 66 to the combustion chamber 68.

A liner 72 circumferentially surrounds at least a portion of the combustion chamber 68, and a transition duct 74 downstream from the liner 72 may connect the combustion chamber 68 to the inlet of the turbine 48. Alternately, the liner 72 and the transition duct 74 may be provided as a single, unitary component. A flow sleeve 80 may circumferentially surround the liner 72, defining an annular passage between the flow sleeve 80 and the liner 72 at the upstream end of the combustor 42. Similarly, an impingement sleeve 76 may circumferentially surround the transition duct 74, defining an annular passage between the impingement sleeve 76 and the transition duct 74 at the downstream end of the combustor 42. One or both of the flow sleeve 80 and the impingement sleeve 76 may be considered an "outer sleeve." The respective upstream and downstream annular passages are fluidly connected to one another, such that an annular passage 82 is defined radially outward of the liner 72 and the transition duct 74 and extends a majority of the length of the combustor 42.

The compressed working fluid 38 may pass through a number of flow openings 78 located in the outer sleeve (i.e., the impingement sleeve 76 and/or flow sleeve 80) and into the annular passage 82. The flow openings 78 may be circular, slots, or other shapes and may direct the working fluid flow through the impingement sleeve 76 or flow sleeve 80 in a perpendicular direction relative to the impingement sleeve 76 or flow sleeve 80, or at some other angle. Further, the flow openings 78 may be of different sizes and/or of different numbers. The "collective effective area" of the flow openings 78 is the combined area through which the working fluid 38 can pass and may be calculated as the total (or sum) cross-sectional area of the flow openings 78 multiplied by the coefficient of flow. The coefficient of flow is the ratio of the actual and theoretical maximum flows through the flow openings 78.

The compressed working fluid 38 cools the surface of the transition duct 74 and the liner 72, as it travels in the upstream direction toward the end cover 62. When the compressed working fluid 38 reaches the end cover 62, the compressed working fluid 38 reverses direction to flow through the fuel nozzles 70, where it is introduced with fuel into the combustion chamber 68.

The combustor 42 may further include a secondary combustion zone or region, having one or more fuel injectors 84 that are circumferentially arranged around the combustion chamber 68 to provide fluid communication radially through the liner 72 and/or the transition duct 74 into the combustion chamber 68. The present invention is not limited to any particular location or type of fuel injectors 84 unless specifically recited in the claims, and FIG. 3 provides an enlarged side cross-section view of an exemplary fuel injector 84 through the liner 72 within the scope of the present invention.

Figure 3:
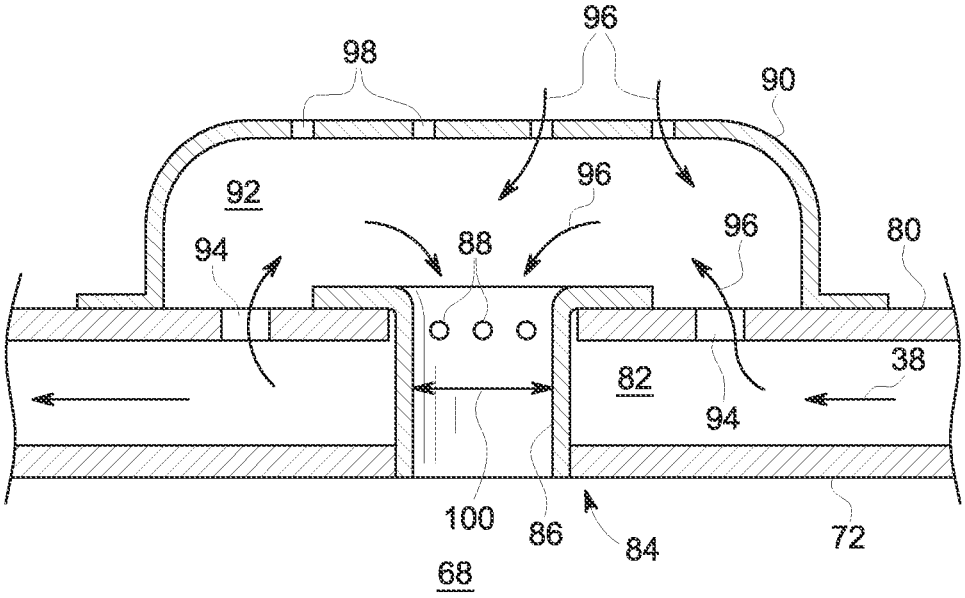
FIG. 3 is a side cross-section view of an exemplary fuel injector shown in FIG. 2.

As shown in FIG. 3, each fuel injector 84 may include a tube 86 or other passage that provides fluid communication through the flow sleeve 80 and the liner 72 into the combustion chamber 68, and a plurality of fuel ports 88 provide fluid communication for fuel to flow into the combustion chamber 68. In the exemplary embodiment shown in FIG. 3, the tube 86 is substantially perpendicular to the flow sleeve 80 and liner 72 to inject the fuel-air mixture transverse to the flow of combustion products within the combustion chamber 68; however, in other embodiments, the tube 86 may be angled axially and/or circumferentially with respect to the flow sleeve 80 and/or liner 72.

In the particular embodiment shown in FIG. 3, a cap 90 may be associated with one or more of the fuel injectors 84 to define a separate volume 92 around the particular fuel injector 84 outside of the flow sleeve 80. Each cap 90 may be bolted or otherwise fixedly connected to the flow sleeve 80, for example around a circumference of the particular fuel injector 84, to define the separate volume 92 around the particular fuel injector 84. One or more fluid passages 94 through the flow sleeve 80 may provide fluid communication from the annular passage 82, through the flow sleeve 80, and into each separate volume 92. In particular embodiments, the fluid passages 94 through the flow sleeve 80 may be upstream from the particular fuel injector 84, while in other embodiments, the fluid passages 94 through the flow sleeve 80 may circumferentially surround each particular fuel injector 84, as in the particular embodiment shown in FIG. 3. In this manner, the compressed working fluid 38 may provide cooling to the outside of the liner 72, and a portion of the compressed working fluid 96 may be diverted through the fluid passages 94 and into the separate volume 92 surrounding the particular fuel injector 84. The diverted portion of the compressed working fluid 96 may then mix with fuel from the fuel ports 88 (fuel supply not shown) before flowing into the combustion chamber 68 to provide a premixed injection of fuel and air for secondary combustion.

The cap 90 and separate volume 92 created by the cap 90 may isolate the particular fuel injector 84 from the pressure and flow variations typically present in the compressor discharge plenum 40. In addition, in some instances, one or more flow passages 98 through the caps 90 may provide fluid communication from the compressor discharge plenum 40 directly into each separate volume 92. In this manner, the flow passages 98 may allow additional compressed working fluid 96 to flow directly into the volume 92 and bypass the annular passage 82 to increase the amount of compressed working fluid 38 diverted through the particular fuel injector 84.

It should be understood that the fuel injector 84 shown in FIG. 3 is merely one exemplary injector, and other injector designs or configurations may be used instead. The present disclosure is not limited to the exemplary fuel injector design, as the principles disclosed herein are equally applicable to any style of injectors in a secondary combustion zone.

Regardless of the injector design, the amount of compressed working fluid 96 diverted through the fuel injectors 84 is directly proportional to an effective area 100 of the fuel injectors 84 for each combustor 42. The effective area 100 of each fuel injector 84 is the net area through which the diverted compressed working fluid 96 can pass into or out of the fuel injector 84 and may be calculated as the total minimum cross-sectional area in the fuel injector 84 multiplied by the coefficient of flow. The coefficient of flow is the ratio of the actual and theoretical maximum flows through the fuel injector 84.

In the exemplary embodiment shown in FIG. 3, for example, the effective area 100 of the fuel injector is calculated from the minimum cross-sectional area inside the tube 86 through which the diverted compressed working fluid 96 flows out of the fuel injector 84 and into the combustion chamber 68. In other particular embodiments, the effective area 100 may be calculated from the sum of the cross-sectional areas of the fluid passages 94 and/or flow passages, if present, through which the diverted working fluid 96 flows.

Figure 4:
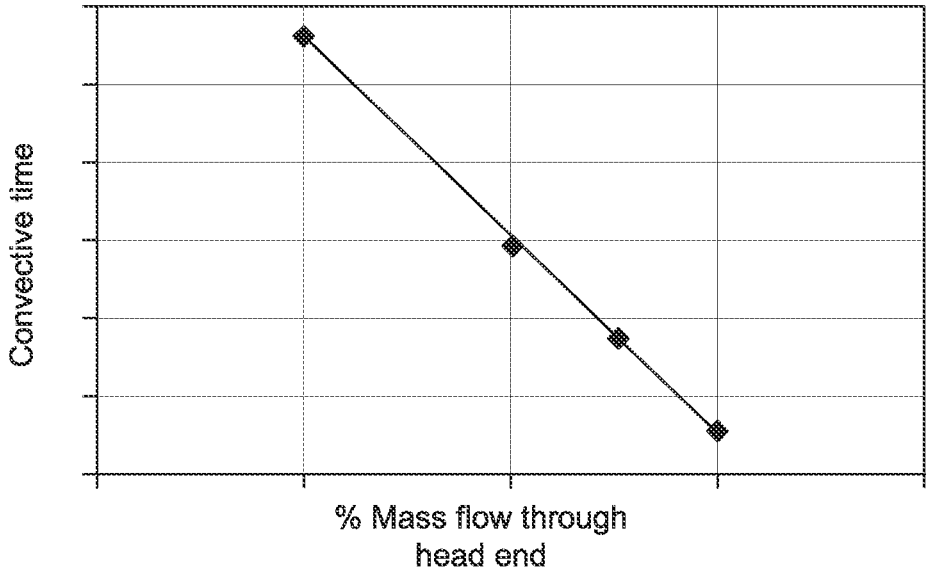
FIG. 4 is an exemplary graph of the relationship between the percent of mass flow through the head end and the convective time for the fuel nozzle.
Figure 5:
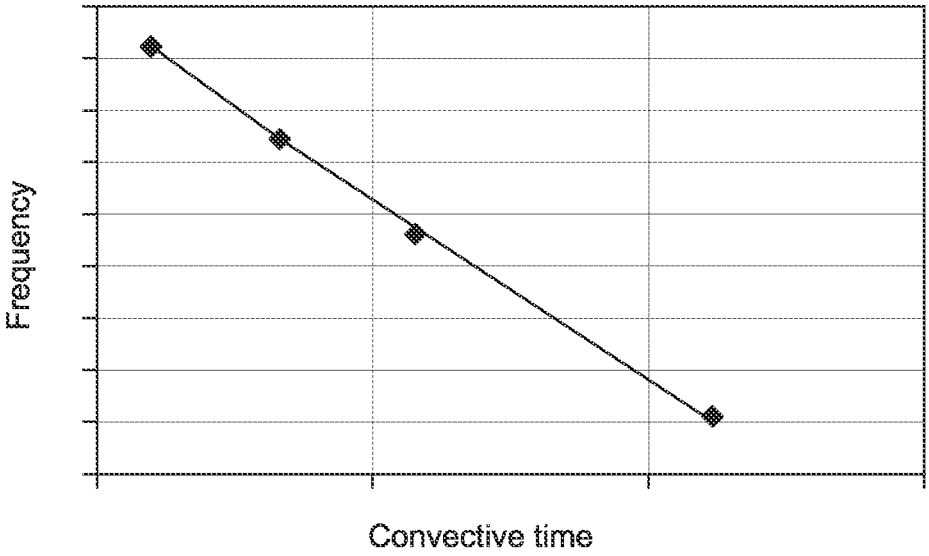
FIG. 5 is an exemplary graph of the relationship between the convective time for the fuel nozzle and combustor frequency.

The amount of compressed working fluid 38 that flows through the head end 66 and fuel nozzles 70 determines the convective time and, therefore, the combustion instability frequency associated with the combustors 42. FIG. 4 provides an exemplary graph of the relationship between the percent of mass flow of the compressed working fluid 38 through the head end 66 and the convective time for the fuel nozzles 70. As shown in FIG. 4, the convective time increases as the percent of mass flow of the compressed working fluid 38 through the head end 66 decreases. FIG. 5 provides an exemplary graph of the relationship between the convective time for the fuel nozzles 70 and the frequency of the combustors 42. As shown in FIG. 5, as the convective time increases, the frequency decreases.

Thus, one way to achieve a decrease in the combustion instability frequency of a particular combustor 42 is to decrease the percent of mass flow of the compressed working fluid 38 directed through the head end 66. Further, it has been found that, to reduce the likelihood of modal coupling of the frequencies of combustors 42 in a gas turbine, it is desirable to create a frequency difference between one or more combustors 42 of the combustor array and at least one of the other combustors 42 in the combustor array.

Figure 6:
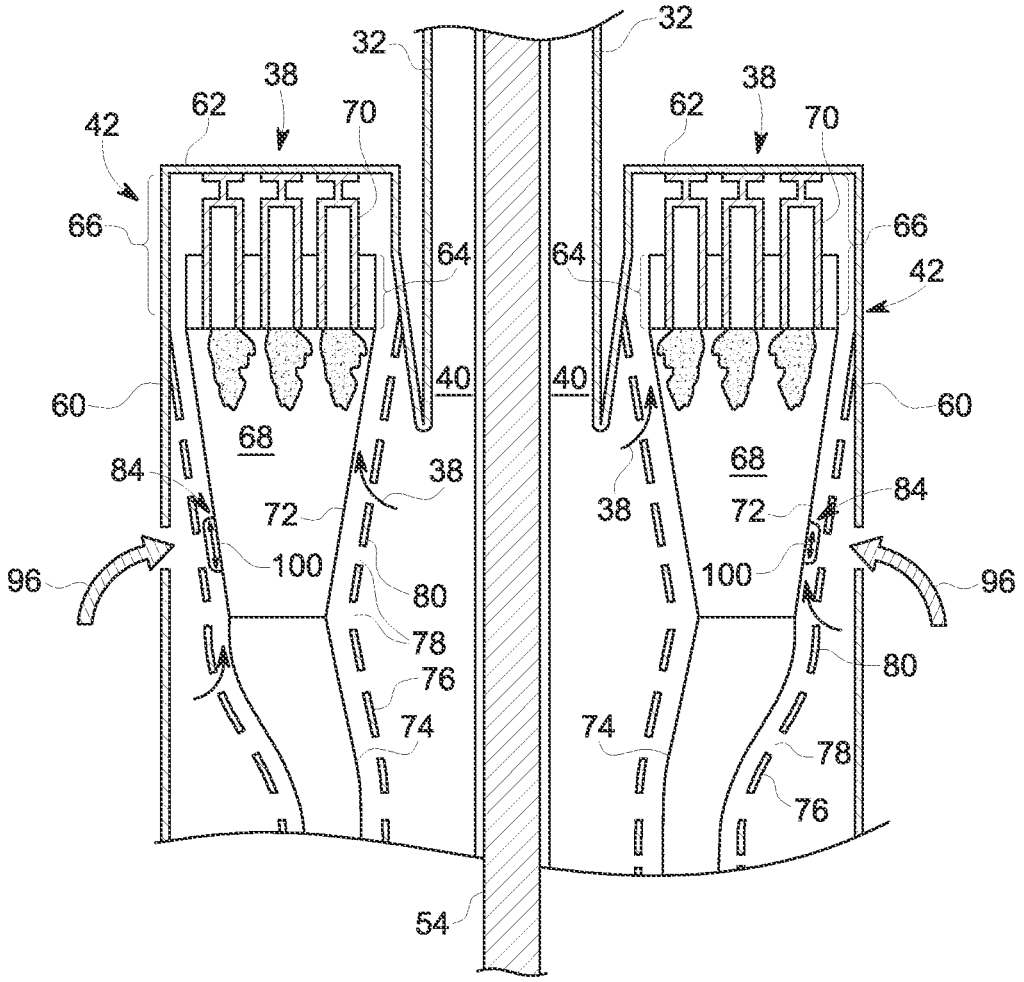
FIG. 6 is simplified side cross-section view of the combustion section shown in FIG. 1 according to a first embodiment of the present invention.
Figure 7:
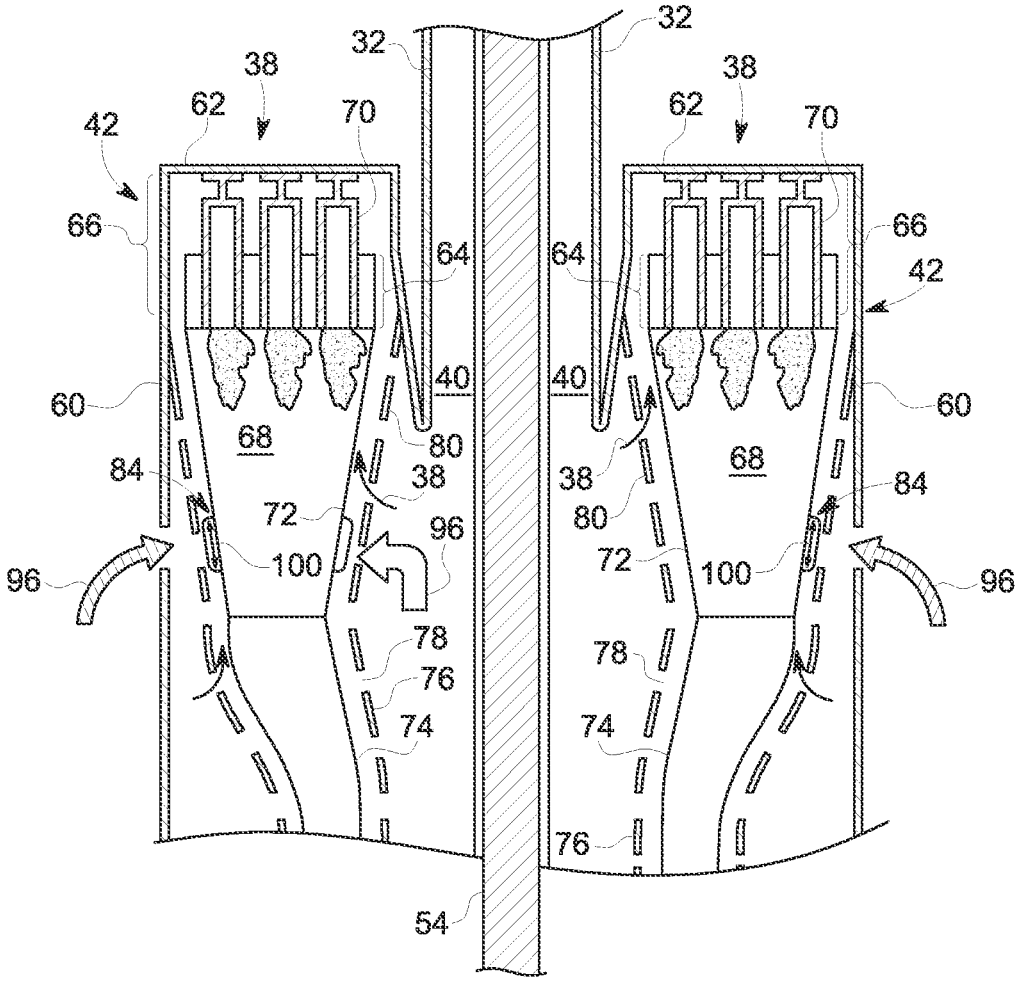
FIG. 7 is a simplified side cross-section view of the combustion section shown in FIG. 1 according to a second embodiment of the present invention.
Figure 8:
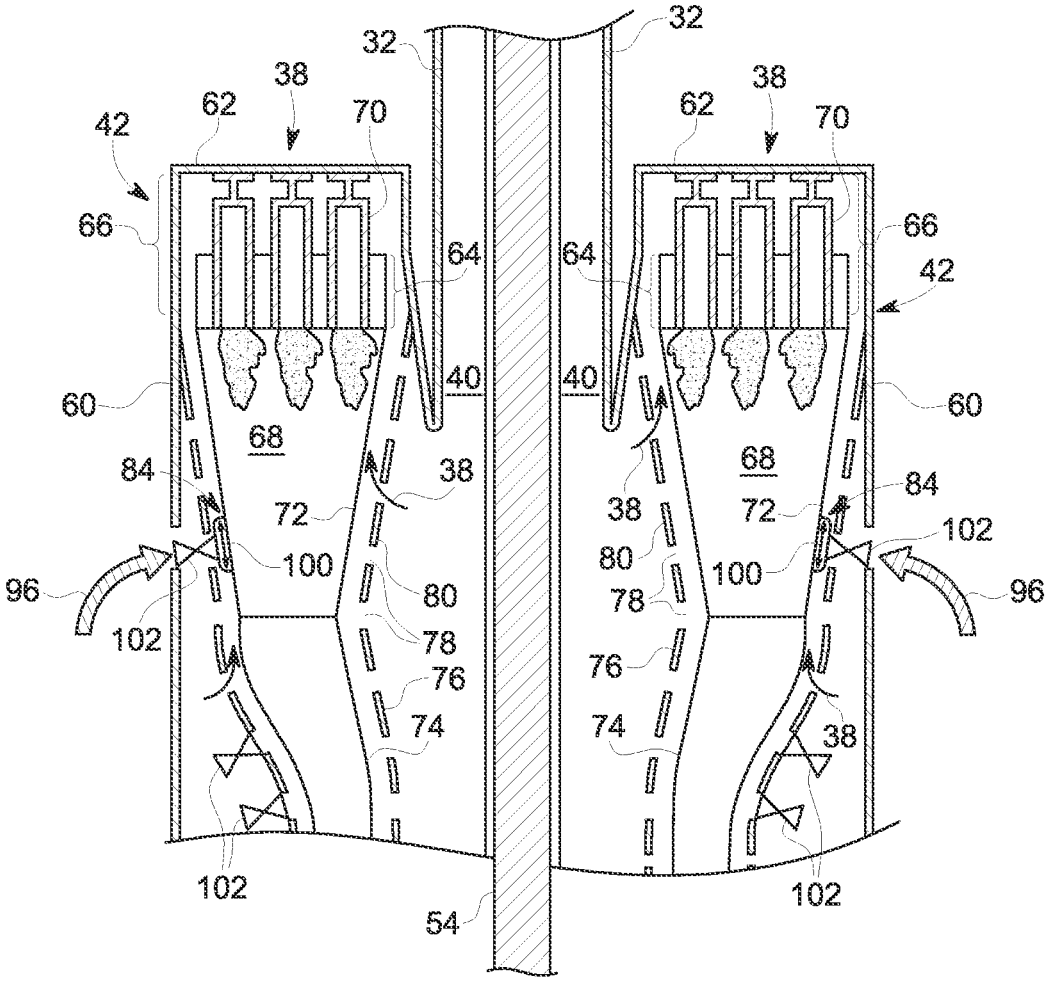
FIG. 8 is a simplified side cross-section view of the combustion section shown in FIG. 1 according to a third embodiment of the present invention.

The amount of compressed working fluid 96 diverted through the fuel injectors 84 reduces the amount of compressed working fluid 38 available to flow through the head end 66 and fuel nozzles 70, provided the total effective area of each combustor 42 is approximately the same. The effective area of each combustor can be maintained by compensating for a change in effective area of the fuel injectors 84 in a combustor 42 by a corresponding change in the effective area of the flow holes 78 through the impingement sleeve 76 and/or flow sleeve 80 in the same combustor 42. In particular embodiments of the present invention, the amount of compressed working fluid 96 diverted through the fuel injectors 84 and flow holes 78 may be different and/or adjusted for each combustor 42 to change the amount of compressed working fluid 38 that flows through the head end 66 and fuel nozzles 70 for each combustor 42. The different amounts of compressed working fluid 38 flowing through the head end 66 and fuel nozzles 70 of each combustor 42 produces different convective times and frequencies between combustors 42 to reduce the modal coupling of combustion dynamics. FIGS. 6-8 illustrate various embodiments within the scope of the present invention for varying the amount of compressed working fluid 96 diverted through the fuel injectors 84.

FIG. 6 provides a simplified side cross-section view of the combustion section 16 shown in FIG. 1 according to a first embodiment of the present invention. Although two representative and oppositely disposed combustors 42 are shown in FIG. 6, the present invention is not limited to any specific number of combustors 42 or any specific spatial relationship of the combustors 42 to one another, unless recited in the claims.

As shown in FIG. 6, each combustor 42 includes multiple fuel nozzles 70 radially arranged in the head end 66 to provide fluid communication through the cap assembly 64 and into the combustion chamber 68. Each combustor 42 further includes a secondary combustion zone having a set of one or more fuel injectors 84 that provide fluid communication radially through the liners 72 and into the combustion chambers 68.

According to an aspect of the present disclosure, the set of fuel injectors 84 in a first combustor 42 (shown on the left side of FIG. 6) are larger and/or define a larger effective area 100 for fluid flow than the set of fuel injectors 84 in a second combustor (shown on the right side of FIG. 6). This difference in effective areas 100 may be accomplished by any combination of varying the diameter of the tubes 86 and/or the passages 94, 98 of the fuel injectors 84, previously described with respect to FIG. 4. In addition, to maintain the comparable fluid flow rates through each combustor 42, the flow openings 78 through the impingement sleeve 76 and/or flow sleeve 80 in the first combustor may be smaller and/or fewer, thereby defining a smaller collective effective area for fluid flow, than the flow openings 78 through the impingement sleeve 76 and/or flow sleeve 80 in the second combustor. It should be noted that the relative sizes of the fuel injectors 84 and the flow openings 78 are exaggerated for clarity and do not necessarily represent actual dimensions.

As the compressed working fluid 38 flows from the compressor discharge plenum 40 to each combustor 42, a portion of the compressed working fluid 96 flows through the fuel injectors 84 in the secondary combustion zone, and the remainder of the compressed working fluid 38 flows through the fuel nozzles 70 in the head end 66 of each combustor 42, as previously described with respect to FIG. 2. The larger effective area 100 of the fuel injectors 84 combined with the smaller effective area of the flow holes 78 in the first combustor allows a larger amount and/or flow rate of compressed working fluid 96 to be diverted through the fuel injectors 84 in the first combustor, as compared to the fuel injectors 84 in the second combustor. As a result, the volume and/or flow rate of compressed working fluid 38 available to flow through the fuel nozzles 70 is greater for the second combustor 42 (on the right) as compared to the first combustor 42 (on the left).

As previously discussed with respect to FIGS. 4 and 5, the larger flow rate through the head end 66 and fuel nozzles 70 of the primary combustion system produces a shorter convective time and higher frequency for the second combustor 42, as compared to the first combustor 42. The difference in combustion instability frequency between the two combustors 42 reduces coherence between the combustors 42, thereby reducing the modal coupling of combustion dynamics between combustors 42.

FIG. 7 provides a simplified side cross-section view of the combustion section 16 shown in FIG. 1 according to a second aspect of the present disclosure. In this exemplary configuration, each fuel injector 84 in the secondary combustion zones may have the same effective area 100. However, the first combustor 42 (shown on the left) has more fuel injectors 84 than the second combustor 42 (shown on the right), allowing a larger amount and/or flow rate of compressed working fluid 96 to be diverted through the fuel injectors 84 in the first combustor 42, as compared to the fuel injectors 84 in the second combustor. In addition, to maintain the comparable fluid flow rates through each combustor 42, the flow openings 78 through the impingement sleeve 76 and/or flow sleeve 80 in the first combustor 42 may be smaller and/or define a smaller effective area for fluid flow than the flow openings 78 through the impingement sleeve 76 and/or flow sleeve 80 in the second combustor 42.

As a result of these different effective areas, the volume and/or flow rate of compressed working fluid 38 available to flow through the fuel nozzles 70 at the head end 66 of the second combustor is greater than that available for the fuel nozzles 70 of the first combustor 42. As previously discussed with respect to FIGS. 4 and 5, the larger flow rate through the head end 66 and fuel nozzles 70 produces a shorter convective time and higher frequency for the second combustor 42, as compared to the first combustor 42. The difference in frequency between the two combustors 42 reduces coherence between the combustors 42, thereby reducing the modal coupling of combustion dynamics between combustors 42.

Although the first combustor 42 is shown with two fuel injectors 84 and the second combustor is shown with one fuel injector 84, it should be recognized that any number of fuel injectors 84 may be used in either combustor, provided the number of fuel injectors 84 in the first combustor is different from the number of fuel injectors 84 in the second combustor 42. Further, it should be appreciated that the fuel injectors 84 in the combustors 42 may be arranged with different circumferential spacing (that is, the fuel injectors 84 do not have to be oppositely disposed, or otherwise uniformly spaced, around the circumference of the combustor 42).

FIG. 8 provides a simplified side cross-section view of the combustion section 16 shown in FIG. 1 according to a third aspect of the present disclosure. In this exemplary configuration, each combustor 42 may have the same number of fuel injectors 84 in its secondary combustion zone, and each fuel injector 84 may have the same effective area 100. However, one or more valves 102 (or other means) may be positioned in the flow path of the compressed working fluid 38, such that the valves 102 are in fluid communication with the fuel injectors 84 and/or the flow openings 78. The valves 102 vary the amount and/or flow rate of compressed working fluid 96 that is diverted through each fuel injector 84 and/or through the flow openings 78 in the impingement sleeve 76 and/or flow sleeve 80.

The valve 102 or other means may be a throttle valve, globe valve, check valve, slide valve, or other device installed on, or upstream from, the fuel injector 84 and/or flow openings 78 to vary the amount and/or flow rate of the compressed working fluid 96 diverted through the fuel injector 84 and/or through the flow openings 78. As a result, the variation in the amount of flow provided to the fuel injectors 84 and/or through the flow openings 78 produces a corresponding change in the amount of compressed working fluid 38 that is available to flow through the head end 66 and fuel nozzles 70 in each combustor 42. The combination of the fuel injectors 84, flow openings 78, and valves 102 allow the working fluid flowing through each combustor 42 to have a different convective time (from other combustors of the array of combustors 42) and, therefore, a different combustion instability frequency. As described previously, the difference in combustion instability frequencies among the combustors 42 reduces coherence among the combustors 42, thereby minimizing modal coupling of the combustion dynamics between combustors 42.

The embodiments shown and described with respect to FIGS. 1-8 may provide various methods for reducing modal coupling of combustion dynamics in the gas turbine 10. In each embodiment, the method may include flowing the compressed working fluid 38 to multiple combustors 42 and diverting the compressed working fluid 96 through the fuel injector(s) 84 in at least one of the combustors 42 in an amount that is different from one or more of the other combustors 42 in the array. In addition, the amount and/or flow rate of fluid flow through the flow holes 78 in the impingement sleeve 76 and/or flow sleeve 80 may be adjusted to maintain comparable fluid flow rates through each combustor 42 in the array.

In summary, several different approaches to reducing coherence and, therefore, modal coupling have been presented herein. In the approach shown in FIG. 6, for example, the difference in the effective area 100 between the fuel injectors 84 and the effective area of the flow openings 78 allows more compressed working fluid 96 to be directed through the fuel injector 84 for the first combustor 42 (left), as compared to the fuel injector 84 in the second combustor 42 (right). Alternately or in addition, in the approach shown in FIG. 7, the difference in the number of fuel injectors 84 and the effective area of the flow openings 78 for each combustor 42 allows more compressed working fluid 96 to be directed through the fuel injectors 84 for the first combustor 42, as compared to the fuel injector 84 in the second combustor 42. In yet another approach (shown in FIG. 8), valves 102 disposed in fluid communication with the fuel injector(s) 84 and/or flow openings 78 are used to vary the amount and/or flow rate of the compressed working fluid 96 directed through the fuel injector 84, such that the fuel injectors 84 in the first combustor 42 receive an amount and/or flow rate of working fluid 96 different from that directed to and through the fuel injectors 84 in the second combustor 42, while maintaining the same level of total air flow to each of the first and second combustors.

As described, reducing the portion of the compressed working fluid 38 flowing through the fuel injectors 84 increases the portion of compressed working fluid 38 flowing through the head end 66 and fuel nozzles 70, assuming the effective area of each combustor 42 in the array is approximately the same. The converse is also true, increasing the portion of compressed working fluid 38 flowing through the fuel injectors 84 decreases the portion of compressed working fluid 38 flowing through the head end 66 and fuel nozzles 70, when the effective area of each combustor 42 in the array is approximately the same. The difference in flow through the head end 66 and the fuel nozzles 70 produces a different convective time and, therefore, a different associated combustion instability frequency in one or more combustors 42 compared to the other combustors 42 in the array. Each approach described above produces a difference in the combustion instability frequencies in one or more of the combustors 42 in the combustor array.

For example, in the embodiments shown in FIGS. 6-8, the method may include flowing a larger amount and/or flow rate of the compressed working fluid 38 through the head end 66 and fuel nozzles 70 of the second combustor 42, as compared to the first combustor 4. As a result, the convective time will be shorter for the second combustor 42, resulting in a corresponding higher combustion instability frequency for the second combustor 42, the terms "shorter" and "higher" being relative to the first combustor 42. The different convective times and combustion instability frequencies between the combustors 42 reduce coherence between the combustors 42, thereby reducing the modal coupling of combustion dynamics between combustors 42.

The systems depicted in FIGS. 6, 7, and 8 may include two or more combustors 42 incorporated into the gas turbine 10 or other turbo-machine. Using the means for producing a combustion instability frequency in at least one combustor 42 that is different from the combustion instability frequency in at least one other combustor 42, each combustor 42 may be adjusted or tuned to achieve a desired combustion instability frequency or amplitude.

Although the examples described in FIGS. 6-8 illustrate the principles of the invention with reference to two oppositely disposed combustors 42, it should be understood that the principles are applicable to any number of combustors 42 in an array. Further, it should be appreciated that the combustors may be modified in groups of one or more combustors, such that a group of multiple combustors may produce a single combustion instability frequency that is different from the combustion instability frequency of the combustors not in the group. Multiple groups of combustors, each producing its own combustion instability frequency, may be employed, and no particular spatial arrangement of the combustors 42 in a group (e.g., adjacent or alternating) is required. It should be recognized that it is not necessary for each individual combustor in the array to produce its own unique combustion instability frequency, in order to achieve a reduction in coherence and, therefore, modal coupling.

By way of example and not limitation, a first group of the combustors 42 may be adjusted and/or tuned to achieve a first combustion instability frequency, a second group of the combustors 42 may be adjusted and/or tuned to achieve a second combustion instability frequency, and a third group of the combustors 42 may be adjusted and/or tuned to achieve a third combustion instability frequency. The first, second, and third combustion instability frequencies are different from one another. As a result, the combustion instability frequencies associated with the combustors 42 cannot coherently or constructively interfere with one another, reducing modal coupling and, therefore, the ability of the combustion system to drive sympathetic vibrations in the downstream turbine section 18. Though three groups and three frequencies are described, it should be clear that any number of groups and/or frequencies may be employed.

The various embodiments described and illustrated with respect to FIGS. 1-8 may provide one or more of the following advantages over existing combustors 42. Specifically, changing the amount and/or flow rate of the compressed working fluid 96 diverted through the fuel injectors 84, while maintaining the effective area of the combustor by also changing the amount and/or flow rate of the compressed working fluid 96 flowing through the flow holes 78 in each combustor 42 may decouple the combustion dynamics, thereby reducing coherence and/or modal coupling of combustion dynamics. As a result, the various embodiments described herein may enhance thermodynamic efficiency, promote flame stability, and/or reduce undesirable emissions over a wide range of operating levels, without detrimentally impacting the life of the downstream hot gas path components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for reducing modal coupling of combustion dynamics in a gas turbine (10), the system comprising:

a. a first combustor (42) comprising a first fuel nozzle (70), a first liner (72) that defines a first combustion chamber (68) downstream from the first fuel nozzle (70), a first sleeve (76 and/or 80) surrounding the first liner and defining a first set of flow openings (78) integrated with the first combustor (42), and a first fuel injector (84) downstream of the first fuel nozzle (70) and having an inlet end enclosed by a first cap, the first set of flow openings (78) defining a first collective effective area and the first fuel injector (84) defining a first effective cross-sectional area (100) through the first liner (72) into the first combustion chamber (68), the first effective cross-sectional area being in fluid communication with a first volume defined within the first cap; and b. a second combustor (42) axially aligned with the first combustor (42), wherein the second combustor (42) comprises a second fuel nozzle (70), a second liner (72) that defines a second combustion chamber (68) downstream from the second fuel nozzle (70), a second sleeve (76 or 80) surrounding the first liner and defining a second set of flow openings (78) integrated with the second combustor (42), and a second fuel injector (84) downstream of the second fuel nozzle (70) and having an inlet end enclosed by a second cap, the second set of flow openings (78) defining a second collective effective area and the second fuel injector (84) defining a second effective cross-sectional area (100) through the second liner (72) into the second combustion chamber (68), the second effective cross-sectional area being in fluid communication with a second volume defined within the second cap;

wherein the first collective effective area of the first set of flow openings (78) is larger than the second collective effective area of the second set of flow openings (78) and the second effective cross-sectional area (100) is larger than the first effective cross-sectional area (100); and wherein the first volume and the second volume receive a flow of air therein, the flow of air being directed, respectively, into the first fuel injector and the second fuel injector.

2. The system as in claim 1, wherein the second fuel injector (84, in second combustor) has a larger effective diameter than the first fuel injector (84, in first combustor).

3. The system as in claim 1, wherein a number of first fuel injectors (84) in the first combustor (42) is different from a number of second fuel injectors (84) in the second combustor (42).

4. The system as in claim 1, further comprising a valve (102) in fluid communication with at least one of the first fuel injector (84, in first combustor) and the second fuel injector (84, in second combustor).

5. The system as in claim 1, wherein the first sleeve is a first flow sleeve (80) that circumferentially surrounds the first liner (72, in first combustor), and wherein the second sleeve is a second flow sleeve (80) that circumferentially surrounds the second liner (72, in second combustor).

6. The system as in claim 5, wherein the second set of flow openings (78, in second combustor) comprises smaller and/or fewer flow openings than the first set of flow openings (78, in first combustor).

7. The system as in claim 5, further comprising a valve (102) in fluid communication with at least some of the flow openings (78).

* * * * *